US005947830A

United States Patent [19]

O'Neill

[11] Patent Number: 5,947,830

[45] Date of Patent: Sep. 7, 1999

[54] GOLF PRACTICE SYSTEM

[76] Inventor: William T. O'Neill, 53-23 192nd St., Flushing, N.Y. 11365-1232

[21] Appl. No.: 09/004,224

[22] Filed: Jan. 8, 1998

[51] Int. Cl.[6] ..... A63B 57/00

[52] U.S. Cl. ..... 473/174; 473/195; 473/219; 206/315.2

[58] Field of Search ..... 473/162, 239, 473/296, 150, 159, 173, 174, 195; 211/70.2; 206/315.2, 315.6

[56] References Cited

U.S. PATENT DOCUMENTS

| | | | |
|---|---|---|---|
| 2,595,987 | 5/1952 | Shears | 206/315.6 |
| 5,235,780 | 8/1993 | Colbert | 47/41.12 |
| 5,282,619 | 2/1994 | Napolitano | 473/239 |
| 5,573,122 | 11/1996 | Williams | 211/70.2 |

*Primary Examiner*—Jeanette Chapman
*Assistant Examiner*—Stephen L. Blau

[57] ABSTRACT

A new golf practice system for helping a golfer improve their grip on a golf club and fundamentals of golf. The inventive device includes a compact golf club having a standard size club head, a standard size grip, and a reduced shaft therebetween. A golf club container is dimensioned for receiving the grip and shaft of the compact golf club therein. The golf club container has a cylindrical configuration defined by an open upper end, a closed lower end, and a cylindrical side wall therebetween. The open upper end has an arcuate recess extending downwardly thereof for engaging the club head of the compact golf club when positioned within the container. The open upper end has a chain secured thereto. The chain has opposed free ends secured to the open upper end in a diametrically opposed orientation.

9 Claims, 2 Drawing Sheets

GOLF PRACTICE SYSTEM

BACKGROUND OF THE INVENTION

1. Field of the Invention

The present invention relates to golf training aids and more particularly pertains to a new golf practice system for helping a golfer improve their grip on a golf club and fundamentals of golf.

2. Description of the Prior Art

The use of golf training aids is known in the prior art. More specifically, golf training aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf training aids include U.S. Pat. No. 5,330,193 to Ijiri; U.S. Pat. No. 5,026,063 to Rhodes; U.S. Pat. No. Des. 246,003 to Shimada; U.S. Pat. No. 5,083,790 to Wheatley; U.S. Pat. No. 3,979,124 to Uraneck; and U.S. Pat. No. 5,215,307 to Huffman.

While these devices fulfill their respective, particular objectives and requirements, the aforementioned patents do not disclose a new golf practice system. The inventive device includes a compact golf club having a standard size club head, a standard size grip, and a reduced shaft therebetween. A golf club container is dimensioned for receiving the grip and shaft of the compact golf club therein. The golf club container has a cylindrical configuration defined by an open upper end, a closed lower end, and a cylindrical side wall therebetween. The open upper end has an arcuate recess extending downwardly thereof for engaging the club head of the compact golf club when positioned within the container. The open upper end has a chain secured thereto. The chain has opposed free ends secured to the open upper end in a diametrically opposed orientation.

In these respects, the golf practice system according to the present invention substantially departs from the conventional concepts and designs of the prior art, and in so doing provides an apparatus primarily developed for the purpose of helping a golfer improve their grip on a golf club and fundamentals of golf.

SUMMARY OF THE INVENTION

In view of the foregoing disadvantages inherent in the known types of golf training aids now present in the prior art, the present invention provides a new golf practice system construction wherein the same can be utilized for helping a golfer improve their grip on a golf club and fundamentals of golf.

The general purpose of the present invention, which will be described subsequently in greater detail, is to provide a new golf practice system apparatus and method which has many of the advantages of the golf training aids mentioned heretofore and many novel features that result in a new golf practice system which is not anticipated, rendered obvious, suggested, or even implied by any of the prior art golf training aids, either alone or in any combination thereof.

To attain this, the present invention generally comprises a compact golf club having a standard size club head, a standard size grip, and a reduced shaft therebetween. A golf club container is dimensioned for receiving the grip and shaft of the compact golf club therein. The golf club container has a cylindrical configuration defined by an open upper end, a closed lower end, and a cylindrical side wall therebetween. The open upper end has an arcuate recess extending downwardly thereof for engaging the club head of the compact golf club when positioned within the container. The open upper end has a chain secured thereto. The chain has opposed free ends secured to the open upper end in a diametrically opposed orientation. A compact putter is provided having a standard size club head, a standard size grip, and a reduced shaft therebetween. A putting target is provided including an interior canister and an exterior canister. The interior canister has an open upper end, a closed lower end, and a cylindrical side wall therebetween. The open upper end has a lid removably disposed thereover. The exterior canister has an open upper end, a closed lower end, and a cylindrical side wall therebetween. The open upper end of the exterior canister slidably receives the interior canister therein. The exterior canister has a set screw extending inwardly thereof for selectively engaging and elevating the interior canister at a position above a hole formed through the cylindrical side wall of the exterior canister. The hole is dimensioned for receiving a golf ball therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf practice system apparatus and method which has many of the advantages of the golf training aids mentioned heretofore and many novel features that result in a new golf practice system which is not anticipated, rendered obvious, suggested, or even implied by any of the prior art golf training aids, either alone or in any combination thereof.

It is another object of the present invention to provide a new golf practice system which may be easily and efficiently manufactured and marketed.

It is a further object of the present invention to provide a new golf practice system which is of a durable and reliable construction.

An even further object of the present invention is to provide a new golf practice system which is susceptible of a low cost of manufacture with regard to both materials and labor, and which accordingly is then susceptible of low prices of sale to the consuming public, thereby making such golf practice system economically available to the buying public.

Still yet another object of the present invention is to provide a new golf practice system which provides in the apparatuses and methods of the prior art some of the advantages thereof, while simultaneously overcoming some of the disadvantages normally associated therewith.

Still another object of the present invention is to provide a new golf practice system for helping a golfer improve their grip on a golf club and fundamentals of golf.

Yet another object of the present invention is to provide a new golf practice system which includes a compact golf club having a standard size club head, a standard size grip, and a reduced shaft therebetween. A golf club container is dimensioned for receiving the grip and shaft of the compact golf club therein. The golf club container has a cylindrical configuration defined by an open upper end, a closed lower end, and a cylindrical side wall therebetween. The open upper end has an arcuate recess extending downwardly thereof for engaging the club head of the compact golf club when positioned within the container. The open upper end has a chain secured thereto. The chain has opposed free ends secured to the open upper end in a diametrically opposed orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
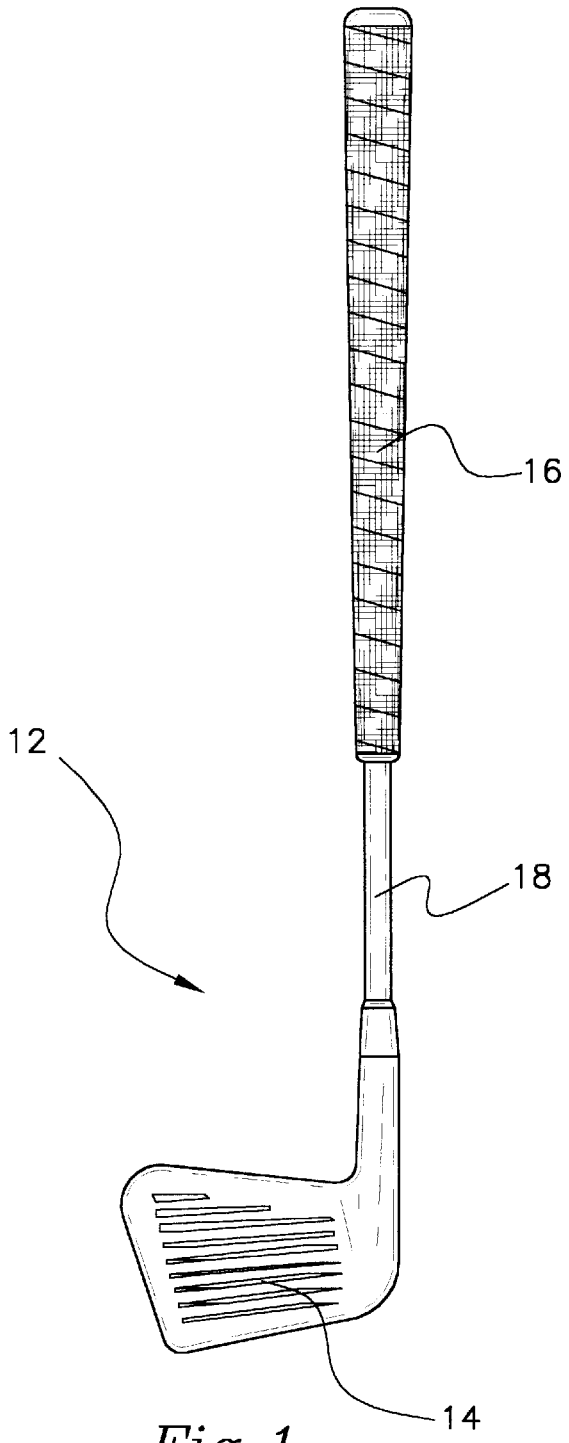
FIG. 1 is a side view of a compact golf club of a new golf practice system according to the present invention.
Figure 2:
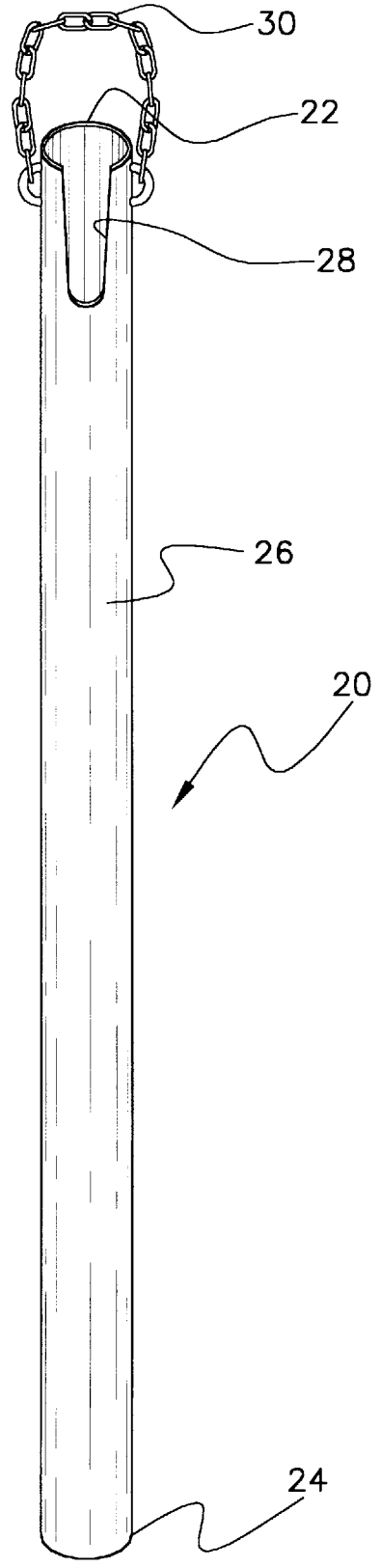
FIG. 2 is a side view of a golf club container of the present invention.
Figure 3:
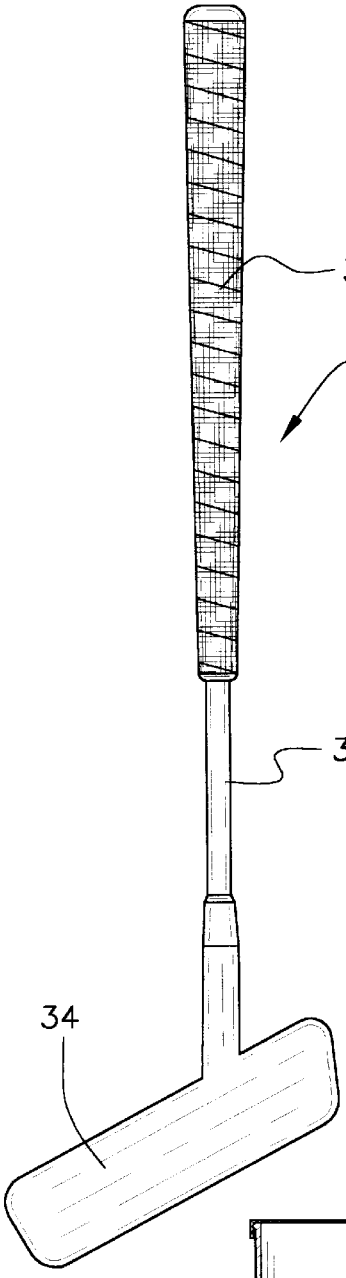
FIG. 3 is a side view of a compact putter of the present invention.
Figure 4:
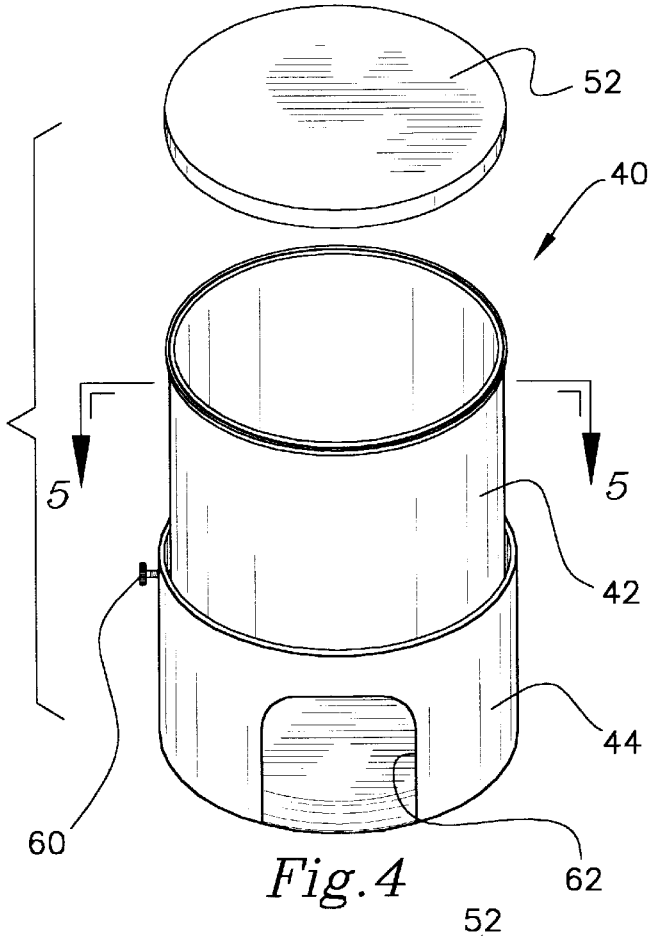
FIG. 4 is a perspective view of a putting target of the present invention.
Figure 5A:
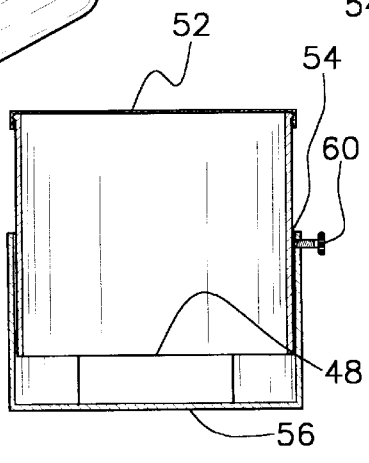
FIG. 5*a* is a cross-sectional view of the putting target of the present invention illustrated in a closed orientation.
Figure 5:
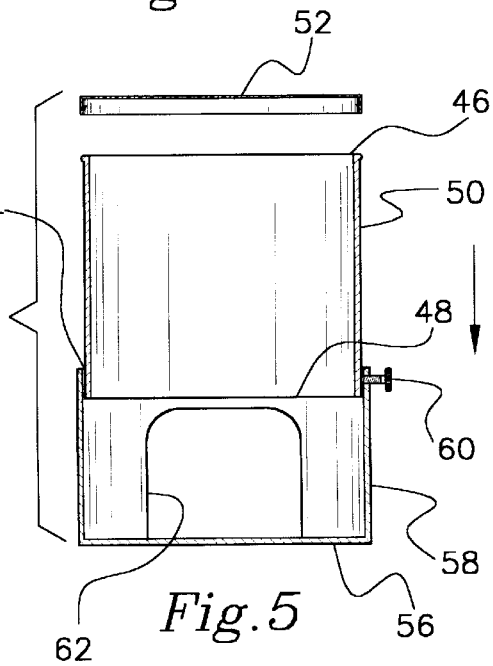
FIG. 5 is a cross-sectional view of the present invention as taken along line 5—5 of FIG. 4.

With reference now to the drawings, and in particular to FIGS. 1 through 5*a* thereof, a new golf practice system embodying the principles and concepts of the present invention and generally designated by the reference numeral 10 will be described.

As best illustrated in FIGS. 1 through 5*a*, the golf practice system 10 comprises a compact golf club 12 having a standard size club head 14, a standard size grip 16, and a reduced shaft 18 therebetween.

A golf club container 20 is dimensioned for receiving the grip 16 and shaft 18 of the compact golf club 12 therein. The golf club container 20 has a cylindrical configuration defined by an open upper end 22, a closed lower end 24, and a cylindrical side wall 26 therebetween. The open upper end 22 has an arcuate recess 28 extending downwardly thereof for engaging the club head 14 of the compact golf club 12 when positioned within the container 20. The open upper end 22 has a chain 30 secured thereto. The chain 30 has opposed free ends secured to the open upper 22 end in a diametrically opposed orientation.

A compact putter 32 is provided having a standard size club head 34, a standard size grip 36, and a reduced shaft 38 therebetween.

A putting target 40 is provided including an interior canister 42 and an exterior canister 44. The interior canister 42 has an open upper end 46, a closed lower end 48, and a cylindrical side wall 50 therebetween. The open upper end 46 has a lid 52 removably disposed thereover. The exterior canister 44 has an open upper end 54, a closed lower end 56, and a cylindrical side wall 58 therebetween. The open upper end 54 of the exterior canister 44 slidably receives the interior canister 42 therein. The exterior canister 44 has a set screw 60 extending inwardly thereof for selectively engaging and elevating the interior canister 42 at a position above a hole 62 formed through the cylindrical side wall 58 of the exterior canister 44. The hole 62 is dimensioned for receiving a golf ball therein. The putting target 40 can be used as a storage vehicle for golf balls and gloves when not in use. Simply removing the lid 52 allows access to the interior canister to store these items. When the interior canister 42 is elevated above the hole 62 and held in place by the set screw 60, the user can practice putting golf balls towards the hole 62.

In use, the present invention would allow a golfer to practice and improve his grip and swing. The present invention allows a golfer to practice his grip at home. This would teach the golfer to grip the club correctly more consistently. The short length of the golf club 12 would allow a golfer to practice a full swing in slow motion or at regular speed indoors without hitting the walls, ceiling, or furniture.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf practice system for helping a golfer improve their grip on a golf club and fundamentals of golf comprising, in combination:

a compact golf club having a club head, a grip, and a reduced shaft therebetween;

a golf club container dimensioned for receiving the grip and shaft of the compact golf club therein, the golf club container having a cylindrical configuration defined by an open upper end, a closed lower end, and a cylindrical side wall therebetween, the open upper end having an arcuate recess extending downwardly thereof for engaging the club head of the compact golf club when positioned within the container, the open upper end having a chain secured thereto, the chain having opposed free ends secured to the open upper end in a diametrically opposed orientation;

a compact putter having a club head, a grip, and a reduced shaft therebetween; and a putting target including an interior canister and an exterior canister, the interior canister having an open upper end, a closed lower end, and a cylindrical side wall therebetween, the open upper end having a lid removably disposed thereover, the exterior canister having an open upper end, a closed lower end, and a cylindrical side wall therebetween, the open upper end of the exterior canister slidably receiving the interior canister therein, the exterior canister having a set screw extending inwardly thereof for selectively engaging and elevating the interior canister at a position above a hole formed through the cylindrical side wall of the exterior canister, the hole being dimensioned for receiving a golf ball therein.

2. A golf practice system for helping a golfer improve their grip on a golf club and fundamentals of golf comprising, in combination:

a compact golf club having a club head, a grip, and a reduced shaft therebetween, wherein the reduced shaft is fixedly coupled to the club head;

a golf club container dimensioned for receiving the grip and shaft of the compact golf club therein, the golf club container having a cylindrical configuration defined by an open upper end, a closed lower end, and a cylindrical side wall therebetween, the open upper end having an arcuate recess extending downwardly thereof for engaging the club head of the compact golf club when positioned within the container, the open upper end having a chain secured thereto, the chain having opposed free ends secured to the open upper end in a diametrically opposed orientation; and a putting target including an interior canister and an exterior canister, the interior canister having an open upper end. a closed lower end, and a cylindrical side wall therebetween, the open upper end having a lid removably disposed thereover, the exterior canister having an open upper ends a closed lower end, and a cylindrical side wall therebetween. the open upper end of the exterior canister slidably receiving the interior canister therein, the exterior canister having a set screw extending inwardly thereof for selectively engaging and elevating the interior canister at a position above a hole formed through the cylindrical side wall of the exterior canister, the hole being dimensioned for receiving a golf ball therein.

3. The golf practice system of claim 2, wherein a length of the reduced shaft of the compact golf club being defined between the club head and the grip, a length of the grip being defined between a free end thereof and the reduced shaft, wherein the length of the reduced shaft is less than about half the length of the grip.

4. The golf practice system of claim 3, wherein the length of the reduced shaft is about one third the length of the grip.

5. The golf practice system of claim 2, further comprising a compact putter having a club head, a grip, and a reduced shaft therebetween.

6. A golf practice system for helping a golfer improve their grip on a golf club and fundamentals of golf comprising, in combination:

a compact putter having a club head, a grip, and a reduced shaft therebetween; and a putting target including an interior canister and an exterior canister, the interior canister having an open upper end, a closed lower end, and a cylindrical side wall therebetween, the open upper end having a lid removably disposed thereover, the exterior canister having an open upper end, a closed lower end, and a cylindrical side wall therebetween, the open upper end of the exterior canister slidably receiving the interior canister therein, the exterior canister having a set screw extending inwardly thereof for selectively engaging and elevating the interior canister at a position above a hole formed through the cylindrical side wall of the exterior canister, the hole being dimensioned for receiving a golf ball therein.

7. The golf practice system of claim 6, wherein a length of the reduced shaft of the compact golf club being defined between the club head and the grip, a length of the grip being defined between a free end thereof and the reduced shaft, wherein the length of the reduced shaft is less than about half the length of the grip.

8. The golf practice system of claim 7, wherein the length of the reduced shaft is about one third the length of the grip.

9. The golf practice system of claim 6, further comprising a compact putter having a club head, a grip, and a reduced shaft therebetween.

* * * * *